US006268316B1

(12) United States Patent
Tanaka et al.

(10) Patent No.: US 6,268,316 B1
(45) Date of Patent: Jul. 31, 2001

(54) LUBRICATING COMPOSITION

(75) Inventors: Noriyoshi Tanaka; Aritoshi Fukushima; Kazuhisa Morita; Yoko Saito; Atsuo Miyashita, all of Tokyo (JP)

(73) Assignee: Asahi Denka Kogyo K.K., Tokyo (JP)

( * ) Notice: Subject to any disclaimer, the term of this patent is extended or adjusted under 35 U.S.C. 154(b) by 0 days.

(21) Appl. No.: 09/534,040

(22) Filed: Mar. 24, 2000

(30) Foreign Application Priority Data

Mar. 29, 1999 (JP) ..... 11-085896

(51) Int. Cl.[7] ..... C10M 141/06

(52) U.S. Cl. ..... 508/291; 508/293; 508/294; 508/295

(58) Field of Search ..... 508/291, 293, 508/294, 295

(56) References Cited

U.S. PATENT DOCUMENTS

| | | | | |
|---|---|---|---|---|
| 5,356,547 | * | 10/1994 | Arai et al. | 508/291 |
| 5,512,192 | * | 4/1996 | Lange et al. | 508/291 |
| 5,627,146 | * | 5/1997 | Tanaka et al. | 508/363 |
| 5,696,065 | * | 12/1997 | Tanaka et al. | 508/465 |
| 5,821,313 | * | 10/1998 | Sivik et al. | 526/265 |
| 5,895,779 | * | 4/1999 | Boffa | 508/555 |
| 6,117,941 | * | 9/2000 | Adams et al. | 508/459 |
| 6,140,280 | * | 10/2000 | Nakano et al. | 508/291 |

* cited by examiner

*Primary Examiner*—Jacqueline V. Howard
(74) *Attorney, Agent, or Firm*—Sughrue, Mion, Zinn, Macpeak & Seas, PLLC

(57) ABSTRACT

In diesel engines, soot is produced by combustion and enters into the engine oil, preventing the engine lubricant from fully exercising its lubricity. The present invention provides a lubricating composition comprising a lubricating basestock, an organic molybdenum compound (A) and succinimide (B) having 0.01 or less of an IR spectrum absorbance peak intensity ratio $\alpha/\beta$, wherein $\alpha$ represents an absorbance peak intensity at 1,550±10 $cm^{-1}$ and $\beta$ represents an absorbance peak intensity at 1,700±10 $cm^{-1}$. Preferably, the organic molybdenum compound is the compound represented by the following formula (1) or formula (2):

(1)

(2)

(wherein $R^1$ to $R^8$ each independently represent a hydrocarbon, and $X^1$ to $X^8$ each independently represent a sulfur atom or an oxygen atom), or a reaction product of an amine and a molybdenum compound having at least one pentavalent or hexavalent molybdenum atom.

6 Claims, 2 Drawing Sheets

LUBRICATING COMPOSITION

BACKGROUND OF THE INVENTION

1. Field of the Invention

The present invention relates to a lubricating composition.

2. Description of the Related Art

Recently, automobile regulations such as regulations regarding fuel consumption and exhaust emissions have become more and more severe. The reasons behind this are environmental problems such as air pollution, acid rain and the like, and protection of resources out of a concern for depletion of finite petroleum energy. As a counter measure, reducing fuel consumption is the most effective solution at present.

When reducing automobile fuel consumption, i.e., when improving fuel consumption, improvements in engine oils such as lowering engine oil viscosity in order to reduce engine frictional loss, adding good friction regulators or the like are just as important as improvements in the automobile itself such as lightening automobile bodies, improvements in engines, etc. Although engine oil acts as a lubricant between pistons and liners, this is where there is a lot of fluid lubrication. So lowering engine oil viscosity can decrease frictional loss. However, even though lowering engine oil viscosity has proposed in recent years, lowering the viscosity causes problems such as defective sealing and increased wear. Engine oil plays an important role in lubricating valve gear, bearings and the like where mixed lubrication and boundary lubrication are mostly employed. Therefore, lowering the viscosity of the engine oil causes increased wear. Friction regulators, extreme pressure agents or the like are added thereto in order to decrease the friction loss and prevent the wear that accompanies a lowering of engine oil viscosity.

Generally, organic molybdenum compounds are added to different types of lubricant oil due to their excellent friction reducing properties. Such compounds are especially effective in engine oils for reducing fuel consumption, which makes them an essential additive for fuel consumption reducing oils. Even though fuel consumption reducing oil shows excellent properties when new, this is not sufficient for excellent fuel consumption reducing oil. Excellent fuel consumption reducing oil must keep their fuel consumption reducing properties for long periods of time. Accordingly, an important theme for current fuel consumption reducing oils is whether the friction reducing effect can be maintained for a long period of time.

Among the organic molybdenum compounds having excellent fuel consumption reducing properties, molybdenum oxysulfide dialkyldithiocarbamates are the most notable ones. These compounds have been known as lubricants for a long time. For example, Japanese Patent Publication No. 53-31646 describes that molybdenum oxysulfide dialkyldithiocarbamate having alkyl groups containing 1 to 24 carbon atoms and containing a sulfur atom and an oxygen atom at a specific ratio is used as a lubricant. Japanese Patent Publication No. 6-47675 discloses molybdenum oxysulfide dialkyldithiocarbamate having asymmetric alkyl groups to improve its solubility to a base oil.

The above-described organic molybdenum compounds are mainly used in gasoline engine oils, and various blends thereof have been developed. On the other hand, where the organic molybdenum compounds are blended into diesel engine oils, there are problems in that the organic molybdenum compounds cannot sufficiently exercise their properties as compared to when they are blended into gasoline engine oils. There are many differences between gasoline engines and diesel engines. A significant factor that affects engine oil is soot. In diesel engines, it is found that soot is produced by combustion and enters into the diesel engine oil.

However, dispersants are added to engine oils to disperse sludge that enters that way. Japanese Patent Laid-open Nos. 10-183153 and 11-21278 describe that alkenyl succinimide-based compounds having specific properties are suitably used for diesel engines.

The present inventors have assumed that soot is the cause of the organic molybdenum compounds not exhibiting sufficient effectiveness in diesel engines and have attempted to blending in various additives into them. As a result, they have successfully developed a lubricating composition that can exhibit excellent fuel consumption reducing properties not only in gasoline engines but also in diesel engines by using a succinimide compound having specific properties with the organic molybdenum compound.

SUMMARY OF THE INVENTION

The present invention provides a lubricating composition comprising a lubricating basestock, an organic molybdenum compound (A) and succinimide (B) having 0.01 or less of an IR spectrum absorbance peak intensity ratio $\alpha/\beta$, wherein $\alpha$ represents an absorbance peak intensity at 1,550±10 $cm^{-1}$ and $\beta$ represents an absorbance peak intensity at 1,700±10 $cm^{-1}$.

The present invention also provides a lubricating composition comprising a lubricating basestock, the organic molybdenum compound (A), the succinimide (B) and zinc dithiophosphate (C) represented by the following formula (4):

(4)

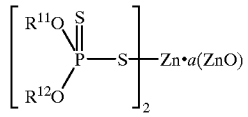

DETAILED DESCRIPTION OF THE INVENTION

Figure 1:
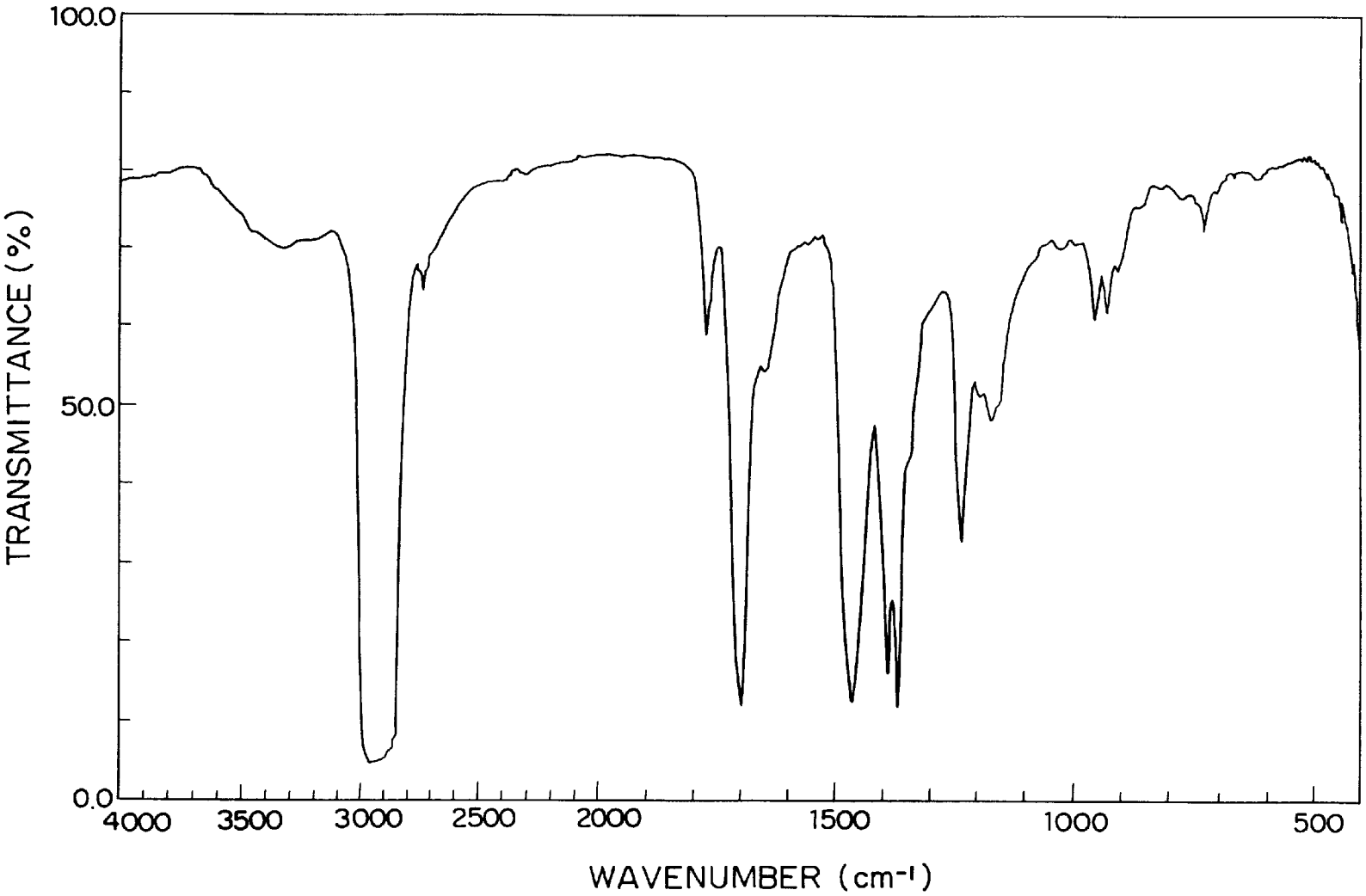
FIG. 1 shows an IR spectrum chart of the component (B-1) used in Example 1.

The organic molybdenum compound (A) includes fatty acid molybdenum salts; molybdenum oxysulfide xanthate; a reaction product of molybdenum trioxide with an acidic phosphate ester; a reaction product of molybdenum trioxide with a fatty acid diethanol amide; a reaction product of molybdenum trioxide with a glycerin mono fatty acid ester; a reaction product of succinimide, a carboxylic acid amide, Mannich base or a boron compound thereof with molybdenum trioxide; or the like. The organic molybdenum compound is most preferably molybdenum oxysulfide dithiocarbamate represented by the formula (1), molybdenum oxysulfide dithiophosphate represented by the formula (2), or a molybdenum amine reaction product of an amine represented by the formula (3) with a molybdenum compound having at least one pentavalent or hexavalent molybdenum atom.

(1)

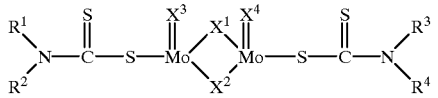

(2)

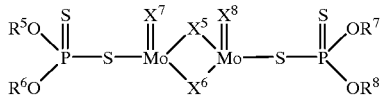

$R^9$-NH-$R^{10}$ (3)

In the formulae (1) to (3), $R^1$ to $R^{10}$ each independently represent a hydrocarbon group such as an alkyl group, an alkenyl group, an aryl group, a cycloalkyl group and a cycloalkenyl group.

Examples of the alkyl group include methyl, ethyl, propyl, isopropyl, butyl, isobutyl, secondary butyl, tertiary butyl, pentyl, isopentyl, secondary pentyl, neopentyl, tertiary pentyl, hexyl, secondary hexyl, heptyl, secondary heptyl, octyl, 2-ethylhexyl, secondary octyl, nonyl, secondary nonyl, decyl, secondary decyl, undecyl, secondary undecyl, dodecyl, secondary dodecyl, tridecyl, isotridecyl, secondary tridecyl, tetradecyl, secondary tetradecyl, hexadecyl, secondary hexadecyl, stearyl, icocyl, dococyl, tetracocyl, triacontyl, 2-butyloctyl, 2-butyldecyl, 2-hexyloctyl, 2-hexyldecyl, 2-octyldecyl, 2-hexyldodecyl, 2-octyldodecyl, 2-decyltetradecyl, 2-dodecylhexadecyl, 2-hexadecyloctadecyl, 2-tetradecyloctadecyl, monomethyl branched isostearyl and the like.

Examples of the alkenyl group include vinyl, allyl, propenyl, butenyl, isobutenyl, pentenyl, isopentenyl, hexenyl, heptenyl, octenyl, nonenyl, decenyl, undecenyl, dodecenyl, tetradecenyl, oleyl and the like.

Examples of the aryl group include phenyl, toluyl, xylyl, cumenyl, mesityl, benzyl, phenetyl, styryl, cynnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecylphenyl, phenylphenyl, benzylphenyl, styrenated phenyl, p-cumylphenyl, α-naphtyl, β-naphtyl groups and the like.

Examples of the cycloalkyl group and cycloalkenyl group include cyclopentyl, cyclohexyl, cycloheptyl, methylcyclopentyl, methylcyclohexyl, methylcycloheptyl, cyclopentenyl, cyclohexenyl, cycloheptenyl, methylcyclopentenyl, methylcyclohexenyl, methylcycloheptenyl groups and the like.

$R^9$ and $R^{10}$ may be each independently a hydrogen atom, but both $R^9$ and $R^{10}$ are never hydrogen atoms. $R^1$ to $R^{10}$ may be the same or different. Also, $R^1$ to $R^4$, $R^5$ to $R^8$, $R^9$ to $R^{10}$ may be the same or different. $R^1$ to $R^4$ are preferably different in order to assure long drain (long lifetime) of the lubricating composition.

Preferably, $R^1$ to $R^{10}$ are each independently an alkyl group, an alkenyl group or an aryl group. More preferably, $R^1$ to $R^4$ in molybdenum oxysulfide dithiocarbamate are each independently an alkyl group having 8 to 13 carbon atoms, $R^5$ to $R^8$ in molybdenum oxysulfide dithiophosphate are each independently an alkyl group having 6 to 13 carbon atoms, and $R^9$ to $R^{10}$ in the molybdenum amine compound are each independently an alkyl group having 6 to 18 carbon atoms. If too small numbers of carbon atoms are used, oil solubility becomes poor. On the other hand, if too large numbers of carbon atoms are used, melting point becomes high, resulting in an poor handling and low activity.

In the formulae (1) and (2), $X^1$ to $X^4$, $X^5$ to $X^8$ are each independently a sulfur atom or an oxygen atom. All of $X^1$ to $X^4$ and $X^5$ to $X^8$ may be sulfur atoms or oxygen atoms. Although all four of $X^1$ to $X^4$ or $X^5$ to $X^8$ may each be independently sulfur atoms or oxygen atoms, it is especially preferred that the ratio of sulfur/oxygen in $X^1$ to $X^4$ or $X^5$ to $X^8$ be in the range of 1/3 to 3/1 in view of lubricity and corrosion resistance.

Examples of the compound having at least one pentavalent or hexavalent molybdenum atom that are reacted with the amine represented by the formula (3) include molybdenum trioxides or hydrates thereof ($MoO_3.nH_2O$), molybdenum acid ($H_2MoO_4$), molybdenum acid alkali metal salts ($M_2MoO_4$), molybdenum acid ammonium salts ($(NH_4)_2MoO_4$ or $(NH_4)_6$ [$Mo_7O_{24}$]; $4H_2O$), $MoCl_5$, $MoOCl_4$, $MoO_2Cl_2$, $MoO_2Br_2$, $Mo_2O_3Cl_6$ and the like. In view of yield of the molybdenum amine reaction product, hexavalent molybdenum compounds are preferred. Among the hexavalent molybdenum compounds, easily available molybdenum trioxides and hydrates thereof, molybdenum acid, molybdenum alkali metal salts and molybdenum ammonium salts are preferred.

The component (A) may be one or more of molybdenum oxysulfide dithiocarbamate represented by formula (1), molybdenum oxysulfide dithiophosphate represented by formula (2), and a molybdenum amine reaction product of the amine represented by formula (3) with the molybdenum compound having at least one pentavalent or hexavalent molybdenum atom. When two or more of them are used, at least one of them is preferably molybdenum oxysulfide dithiocarbamate.

Although the amount of the component (A) is not especially limited, too an small amount causes insufficient friction reducing effect and too large an amount may cause sludge production and corrosion. It is commonly considered that a relatively small amount (approximately 0.03% by weight or less calculated in terms of the amount of molybdenum based on the lubricating basestock) of the organic molybdenum compound shows wear resistance and a relatively large amount of the same apparently shows a friction reducing effect. Accordingly, the amount of the molybdenum is preferably 0.001 to 3% by weight, more preferably 0.005 to 2% by weight, and most preferably 0.01 to 1% by weight calculated in terms of the amount of molybdenum based on the lubricating basestock.

The succinimide compound (B) for use in the present invention has 0.01 or less, preferably 0.007 or less of an IR spectrum absorbance peak intensity ratio α/β (wherein a represents an absorbance peak intensity at a wave number of 1,550±10 $cm^{-1}$ and β represents an absorbance peak intensity at a wave number of 1,700±10 $cm^{-1}$). The absorbance peak intensity is calculated herein on the basis of a peak height in which a background is subtracted. Examples of the succinimide compound (B) include polyalkenylsuccinimides such as a compound represented by the following formula (B-1) (other than the arrow):

(B-1)

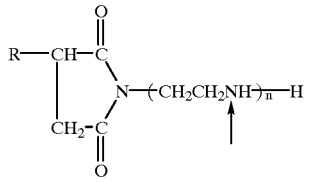

(wherein R represents a polyalkenyl group such as polybutenyl group, n represents about 1 to 10) and a compound represented by the following formula (B-2) (other than the arrow):

(B-2)

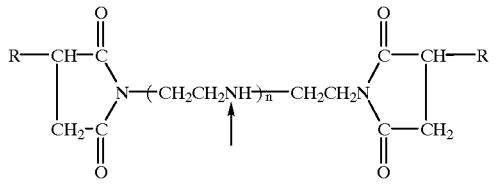

(wherein R represents a polyalkenyl group such as polybutenyl group, n represents about 1 to 10) and the like. At the positions designated by the arrows, a boron compound represented by the formula (D2-a) or (D2-b) hereinafter described may be coordinated. The succinimide compound herein preferably has a molecular weight of 500 to 10,000. The polyalkenyl group generally has a molecular weight of about 300 to 4,000. Preferably, n is 2 to 5.

Although the amount of the component (B) is not especially limited, too small an amount causes insufficiently dispersed soot or sludge and too large amount causes less room to add other additives. Accordingly, the amount of the component (B) is preferably 0.5 to 25% by weight, more preferably 1 to 20% by weight based on the lubricating basestock.

The zinc dithiophosphate (C) is represented by the formula (4). Blending the component (C) with the lubricating composition of the present invention further enhances antioxidation and long drain properties. In the formula (4), $R^{11}$ and $R^{12}$ each represent a hydrocarbon group. Each $R^{11}$ and $R^{12}$ is preferably an alkyl group, an alkenyl group, an aryl group and the like. Most preferably, each $R^{11}$ and $R^{12}$ is an alkyl group having 3 to 14 carbon atoms. Two or more zinc dithiophosphates having different $R^{11}$ and $R^{12}$ may be used as the component (C) and a represents 0 to 1/3. When a is 0, the component is referred to as neutral zinc dithiophosphate, and when a is 1/3, the component is referred to as basic zinc dithiophosphate.

Although the amount of the component (C) is not especially limited, a certain amount of component (C) is preferable in order to exhibit practical friction reducing and antioxidation effects. However, large amounts of the component (C) may produce sludge. Accordingly, the amount of the component (C) is preferably 0.001 to 3% by weight, more preferably 0.005 to 2% by weight and most preferably 0.01 to 1% by weight calculated in terms of the amount of phosphorus based on the lubricating basestock.

Depending on applications, the lubricating composition of the present invention can include any one or more of a metal detergent agent (D1), an ashless dispersant other than a succinimide compound (D2), a compound containing at least one phosphorus atom (D3), a compound containing at least one phosphorus atom and at least one sulfur atom (D4), a compound containing at least one sulfur atom and no metal atoms (D5), an antioxidant (D6), an organic metal compound (D7), an oiliness improver containing no metal atoms, phosphorus atoms or sulfur atoms (D8), a preservative (D9), a viscosity index improver (D10), a metal deactivating agent (D11), an antifoaming agent (D12), and a solid lubricant (D13) as a component (D).

Examples of the metal detergent (D1) include metal sulphonates, metal phenates, metal salicylates, metal phosphonates and the like. Examples of the metal sulphonates include (mono- or di-)alkylbenzene metal sulphonates, (mono- or di-)alkylnaphthalene metal sulphonates, petroleum metal sulphonates and the like. Examples of the metal phenates include (mono- or di-)alkylphenol metal salts, thiobis{(mono- or di-)alkylphenol} metal salts, methylenebis{mono- or di-}alkylphenyl} metal salts and the like. Examples of the metal salicylates include (mono- or di-)alkyl metal salicylates, thiobis{(mono- or di-)alkyl salicylate} metal salts, methylenebis{(mono- or di-)alkyl salicylate} metal salts and the like.

The metal atom is preferably an alkali metal atom or an alkaline earth metal atom, more preferably calcium, magnesium and barium.

The above-described compounds are generally referred to as neutral salts. Based or overbased metal detergent that are obtained by blowing carbon dioxide thereinto and subjecting a base treatment with metal oxides or metal hydroxides are preferably used. The overbased products are typically contained in the form of carbonate. Total Base Numbers (TBN) of these based or overbased metal detergent generally range from 200 to 500 mgKOH/g.

Among these metal detergent, most preferred is neutral, based or overbased calcium salicylate or calcium sulphonate. An amount of the component (D1) is approximately 0.5 to 10% by weight based on the lubricating basestock.

Examples of ashless dispersants other than the succinimide-based compound (D2) include benzylamine, succinate esters, a boron compound thereof and the like.

Examples of the benzylamine derived compound (Mannich reaction product) include a compound represented by the following formula (D-2) (other than the arrow):

(D2-1)

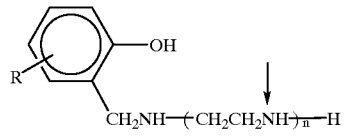

(wherein R represents a polyalkenyl group such as polybutenyl and the like, and n represents about 1 to 10) and the like. The molecular weight of the polyalkenyl group is generally about 300 to 4,000, and n is preferably 2 to 5.

Examples of the succinate ester include a compound represented by the following formula (D2-2) (other than the arrows):

(D2-2)

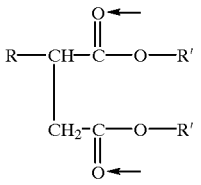

(wherein R represents a polyalkenyl group such as a polybutenyl group, and R' represents a leaving group of monool or polyol minus one hydroxyl group), a compound represented by the following formula (D2-3) (other than the arrows):

(D2-3)

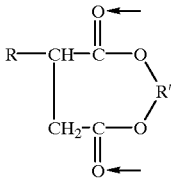

(wherein R represents a polyalkenyl group such as a polybuteyl group, and R' represents a remaining group of polyol minus two hydroxyl groups) and the like. The molecular weight of the polyalkenyl group (D2-1 through D2-3) is generally about 300 to 4,000.

Examples of the boron compound thereof include compounds where the following constituent (D2-a) or (D2-b)

(D2-a)

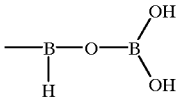

(D2-b)

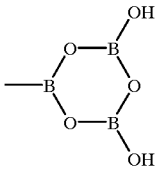

is coordinated at the positions designated by the arrows.

Nitrogen content in the ashless dispersant is generally about 0.5 to 2.0% by weight. The amount of the component (D2) is preferably 0.5 to 10% by weight based on the lubricating basestock.

Examples of the compound containing at least one phosphorus atom (D3) include organic phosphorus compounds such as phosphines, phosphine oxides, phophinites, phosphonites, phosphinates, phosphites, phosphonates, phosphates and phosphoroamidates. These compounds improve mainly lubricity, wear resistance and the like, and may also act as an antioxidant.

Examples of the organic phosphines represented by $(R)_3P$ include tributylphosphine, trihexylphosphine, trioctylphosphin, tri(2-ethylhexyl)phosphine, trinonylphosphine, tridecylphosphine, trilaurylphosphine, trimyristylphosphine, tripalmitylphosphine, tristearylphosphin, trioleylphosphine, triphenylphosphine, tricresylphosphine and the like. Examples of alkylidene bisphosphines represented by $(R)_2P—(CH_2)_n—P(R)_2$ include methylenebis(dibutylphosphine), methylenebis(dihexylphosphine), methylenebis(dioctylphosphine), methylenebis(di2-ethylhexylphosphine), methylenebis(dinonylphosphine), methylenebis(didecyphosphin), methylenebis(dilaurylphosphine), methylenebis(dimyristylphosphine), methylenebis(dipalmityphosphine), methylenebis(distearylphosphine), methylenebis(dioleylphosphine), methylenebis(diphenyiphosphin), methylenebis(dicresylphosphine) and the like.

Examples of the organic phosphine oxides represented by $(R)_3P{=}O$ include tributylphosphine oxide, trihexylphoshpine oxide, trioctylphosphine oxide, tri(2-ethyl hexyl )phosphine oxide, trinonylphosphine oxide, tridecylphosphine oxide, trilaurylphosphine oxide, trimyristylphosphine oxide, tripalmitylphosphine oxide, tristearylphosphine oxide, trioleylphosphine oxide, triphenylphosphine oxide, tricresylphosphine oxide and the like.

Examples of the organic phosphites represented by $(RO)_3P$ and the like include monobutyl phosphite, dibutyl phosphite or tributyl phosphite (hereinafter referred to as "mono/di/tributyl phosphite"), mono/di/trihexyl phosphite, mono/di/trioctyl phosphite, mono/di/tri(2-ethylhexyl)phosphite, mono/di/trinonyl phosphite, mono/di/tridecyl phosphite, mono/di/trilauryl phosphite, mono/di/trimyristyl phosphite, mono/di/tripalmityl phosphite, mono/di/tristearyl phosphite, mono/di/trioleyl phosphite, mono/di/triphenyl phosphite, mono/di/tricresyl phosphite and the like. Other phosphites include pentaerythritol diphosphite, pentaerythritol tetraphosphite, alkylidene bisphosphite and the like.

Examples of the organic phosphates represented by $(RO)_3P{=}O$ and the like include monobutyl phosphate, dibutyl phosphate or tributyl phosphate (hereinafter referred to as "mono/di/tributyl phosphate"), mono/di/trihexyl phosphate, mono/di/trioctyl phosphate, mono/di/tri(2-ethylhexyl) phosphate, mono/di/trinonyl phosphate, mono/di/tridecyl phosphate, mono/di/trilauryl phosphate, mono/di/trimyristyl phosphate, mono/di/tripalmityl phosphate, mono/di/tristearyl phosphate, mono/di/trioleyl phosphate, mono/di/triphenyl phosphate, mono/di/tricresyl phosphate and the like. It may also includes a phosphate having a polyoxyalkylene group, i.e., phosphate of lauryl alcohol ethylene oxide and/or a propylene oxide adduct and the like.

The mono- or diphosphates are referred to as acidic phosphate esters and may be used by neutralizing with base such as alkali, amines and the like. Examples of the alkali includes metal hydroxides such as lithium hydroxide, sodium hydroxide, potassium hydroxide, magnesium hydroxide, calcium hydroxide and the like. Examples of the amines include ammonia; alkylamines such as methylamine, dimethylamine, ethylamine, diethylamine, (iso) propylamine, di(iso)propylamine, butylamine, hexylamine, octylamine, decylamine, dodecylamine, tridecylamine, cetylamine, cocoylalkylamine, soybean alkylamine, beef tallow alkylamine, oleylamine, stearylamine and the like; alkanolamines such as monoethanolamine, N- methyl monoethanolamine, N-ethyl monoethanolamine, diethanolamine, N-methyl diethanolamine, N-ethyl diethanolamine, triethanolamine, 2-amino-2-methyl-1-propanol, 2-amino-2- methyl-1,3-propandiol, aminoethyl ethanolamine, N,N,N',N'-tetrakis(hydroxyethyl) ethylenediamine, N,N,N',N'-tetrakis(2-hydroxypropyl) ethylenediamine and the like and alkylene oxide adducts thereof; N-long chain alkylalkanolamines such as N-butyl diethanolamine, N-hexyl diethanolamine, N-octyl diethanolamine, N-decyl diethanolamine, N-cocoylalkyl diethanolamine, N-soybeanalkyl diethanolamine, N-beef tallowalkyl diethanolamine, N-oleyl diethanolamine, N-stearyl diethanolamine, N,N-dibutyl monoethanolamine, N,N-dihexyl monoethanolamine, N,N-dioctyl monoethanolamine, N,N-didecyl monoethanolamine, N,N-bis(cocoylalkyl)monoethanolamine, N,N-bis(soybeanalkyl) monoethanolamine, N,N-bis(beef tallowalkyl) monoethanolamine, N-dioleyl monoethanolamine, N-distearyl monoethanolamine and the like and alkylene oxide adducts thereof. Examples of the phosphoroamidates include a condensation product of the phosphates listed above and the amines listed above, and the like.

The amount of the component (D3) is preferably about 0.1 to 5% by weight based on the lubricating basestock.

Examples of the compound containing at least one phosphorus atom and at least one sulfur atom (D4) include trithiophsphite, thiophosphate and the like. These compounds mainly enhance lubricity, wear resistance and the like, and may also act as an antioxidant.

Examples of the organic trithiophosphites represented by $(RS)_3P$ and the like include mono-, di- or tributyl trithiophosphite (hereinafter referred to as "mono/di/tributyl trithiophosphite"), mono/di/trihexyl trithiophosphite, mono/di/trioctyl trithiophosphite, mono/di/tri(2-ethylhexyl) trithiophosphite, mono/di/trinonyl trithiophosphite, mono/di/tridecyl trithiophosphite, mono/di/trilauryl trithiophosphite, mono/di/trimyristyl trithiophosphite, mono/di/tripalmityl trithiophosphite, mono/di/tristearyl trithiophosphite, mono/di/trioleyl trithiophosphite, mono/di/triphenyl trithiophosphite, mono/di/tricresyl trithiophosphite and the like.

Examples of the organic thiophosphates represented by $(RO)_3P{=}S$ and the like include mono-, di- or tributyl thiophosphate (hereinafter referred to as "mono/di/tributyl thiophosphate"), mono/di/trihexyl thiophosphate, mono/di/trioctyl thiophosphate, mono/di/tri(2-ethylhexyl) thiophosphate, mono/di/trinonyl thiophosphate, mono/di/tridecyl thiophosphate, mono/di/trilauryl thiophosphate, mono/di/trimyristyl thiophosphate, mono/di/tripalmityl thiophosphate, mono/di/tristearyl thiophosphate, mono/di/trioleyl thiophosphate, mono/di/triphenyl thiophosphate, mono/di/tricresyl thiophosphate and the like.

Dithiophosphoric acid dimers may also be used.

The amount of the component (D4) is preferably about 0.1 to 5% by weight based on the lubricating basestock.

Examples of the compound containing at least one sulfur atom and no metal atoms (D5) include those where the double bonds in fat and oil compounds are sulfurized such as sulfurized lard, sulfurized fish oil, sulfurized whale oil, sulfurized soybean oil, sulfurized pinene oil, sulfurized sperm oil, sulfurized fatty acid; sulfur alone; organic mono- or polysulfide; sulfurized polyolefin such as isobutylene; 1,3,4-thiadiazol derivatives; thiuram disulfide; dithiocarbamate ester and the like.

The organic mono- or polysulfide is a compound represented by the following formula (D5-1):

$$R{-}S_x{-}R \qquad \text{(D5-1)}$$

(wherein R represents a hydrocarbon group, and x represents about 1 to 10) and includes dihydrocarbyl sulfides such as dimethyl monosulfide, dimethyl disulfide, or dimethyl polysulfide (hereinafter referred to as "dimethyl mono/di/polysulfide"), diethyl mono/di/polysulfide, dipropyl mono/di/polysulfide, diisopropyl mono/di/polysulfide, dibutyl mono/di/polysulfide, diisobutyl mono/di/polysulfide, ditertiarybutyl mono/di/polysulfide, dipentyl mono/di/polysulfide, diisopentyl mono/di/polysulfide, dineopentyl mono/di/polysulfide, ditertiarypentyl mono/di/polysulfide, dihexyl mono/di/polysulfide, diheptyl mono/di/polysulfide, dioctyl mono/di/polysulfide, di2-ethylhexyl mono/di/polysulfide, dinonyl mono/di/polysulfide, ditertiarynonyl mono/di/polysulfide, didecyl mono/di/polysulfide, diundecyl mono/di/polysulfide, didodecyl mono/di/polysulfide, ditridecyl mono/di/polysulfide, diisotridecyl mono/di/polysulfide, ditetradecyl mono/di/polysulfide, dihexadecyl mono/di/polysulfide, distearyl mono/di/polysulfide, diisostearyl mono/di/polysulfide, dioleyl mono/di/polysulfide, diicocyl mono/di/polysulfide, didococyl mono/di/polysulfide, ditetracocyl mono/di/polysulfide, ditriacontyl mono/di/polysulfide, diphenyl mono/di/polysulfide, ditoluyl mono/di/polysulfide, dixylyl mono/di/polysulfide, dicumenyl mono/di/polysulfide, dimethycyl mono/di/polysulfide, dibenzyl mono/di/polysulfide, diphenetyl mono/di/polysulfide, distyryl mono/di/polysulfide, dicynnamyl mono/di/polysulfide, dibenzhydryl mono/di/polysulfide, ditrytyl mono/di/polysulfide, di(ethylphenyl)mono/di/polysulfide, di(propylphenyl)mono/di/polysulfide, di(butylphenyl)mono/di/polysulfide, di(pentylphenyl)mono/di/polysulfide, di(hexylphenyl)mono/di/polysulfide, di(heptylphenyl)mono/di/polysulfide, di(octylphenyl)mono/di/polysulfide, di(nonylphenyl)mono/di/polysulfide, di(decylphenyl)mono/di/polysulfide, di(undecylphenyl) mono/di/polysulfide, di(dodecylphenyl)mono/di/polysulfide, di(phenylphenyl)mono/di/polysulfide, di(benzylphenyl)mono/di/polysulfide, di(stylenated phenyl) mono/di/polysulfide, di(p-cumylphenyl)mono/di/polysulfide, dicyclopentyl mono/di/polysulfide, dicyclohexyl mono/di/polysulfide, dicycloheptyl mono/di/polysulfide, dimethylcyclopentyl mono/di/polysulfide, dimethylcyclohexyl mono/di/polysulfide, dimethylcycloheptyl mono/di/polysulfide and the like; dihydrocarbylphenol sulfides such as di(ethylhydroxyphenyl) mono/di/polysulfide, di(propylhydroxyphenyl) mono/di/polysulfide, di(butylhydroxyphenyl) mono/di/polysulfide, di(pentylhydroxyphenyl) mono/di/polysulfide, di(hexylhydroxyphenyl) mono/di/polysulfide, di(heptylhydroxyphenyl) mono/di/polysulfide, di(octylhydroxyphenyl) mono/di/polysulfide, di(nonylhydroxyphenyl) mono/di/polysulfide, di(decylhydroxyphenyl) mono/di/polysulfide, di(undecyhydroxyphenyl) mono/di/polysulfide, di(dodecylhydroxyphenyl) mono/di/polysulfide and the like.

The 1,3,4-thiadiazol derivative is represented by the following formula (D5-2):

(D5-2)

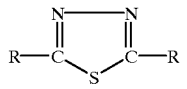

(wherein R represents a hydrocarbon group or a hydrocarbon group containing at least one sulfur atom).

Examples of the hydrocarbon group containing at least one sulfur atom include 5-thianonyl, 2,5-dithianonyl, 3,4-dithiahexyl, 4,5-dithiahexyl, 3,4,5-trithiaheptyl, 3,4,5,6-tetrathiaoctyl, 5-thia-2-heptenyl, 4-thiacyclohexyl, 1,4-dithianaphtyl, 5-(methylthio)octyl, 4-(ethylthio)-2-pentenyl, 4-(methylthio)cyclohexyl, 4-mercaptophenyl, 4-(methylthio)phenyl, 4-(hexylthio)benzyl, stearyldithio, lauryldithio, octyldithio, stearylthio, laurylthio, octylthio, N,N-dialkyldithiocarbamoyl and the like, most preferably the group where 2 to 4 sulfur atoms are combined continuously.

The thiuram disulfide is represented by the following formula (D5-3)

(D5-3)

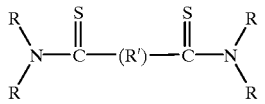

(wherein R represents a hydrocarbon group, and R' represents a sulfur atom, a divalent hydrocarbon group or a divalent hydrocarbon group containing at least one sulfur atom).

Examples of the R' include a group represented by —S(—S)n— (wherein n is 0 or 1 or more), an alkylene group such as a methylene group, a divalent group represented by $—S(—S)_n(—CH_2)_n—S(—S)_n—$ (wherein each n is 0 or 1 more that may be the same or different) and the like. R is preferably a linear hydrocarbon group having 4 or more of carbon atoms.

The dithiocarbamate ester is represented by the following formula (D5-4):

(D5-4)

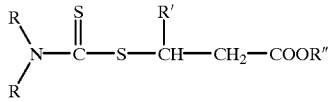

(wherein R represents a hydrocarbon group, R' represents a hydrogen atom, a hydrocarbon group or a group represented by COOR" and R" represents a hydrocarbon group).

The amount of the component (D5) is preferably about 0.1 to 10% by weight based on the lubricating basestock.

The antioxidant (D6) includes a phenol-based antioxidant, an amine-based antioxidant, a sulfur-based oxidant and the like. Examples of the phenol-based antioxidant include 2,6-di-tert-butylphenol (hereinafter "tert-butyl" is referred to as "t-butyl"), 2,6-di-t-butyl-p-cresol, 2,6-di-t-butyl-4-methylphenol, 2,6-di-t-butyl-4-ethylphenol, 2,4-dimethyl-6-t-butylphenol, 4,4'-methylenebis(2,6-di-t-butylphenol), 4,4'-bis(2,6-di-t-butylphenol), 4,4'-bis(2-methyl-6-t-butylphenol), 2,2'-methylenebis(4-methyl-6-t-butylphenol), 2,2'-methylenebis(4-ethyl-6-t-butylphenol), 4,4'-butylidenebis(3-methyl-6-t-butylphenol), 4,4'-isopropilidenebis(2,6-di-t-butylphenol), 2,2'-methylenebis(4-methyl-6-cyclohexylphenol), 2,2'-methylenebis(4-methyl-6-nonylphenol), 2,2'-isobutylidenebis(4,6-dimethylphenol), 2,6-bis(2'-hydroxy- 3'-t-butyl-5'-methylbenzyl)-4-methylphenol, 3-t-butyl-4-hydroxy anisole, 2-t-butyl-4-hydroxy anisole, 3-(4-hydroxy-3,5-di-t-butylphenyl) stearyl propionate, 3-(4-hydroxy-3,5-di-t-butylphenyl) oleyl propionate, 3-(4-hydroxy-3,5-di-t-butylphenyl) dodecyl propionate, 3-(4-hydroxy-3,5-di-t-butylphenyl) decyl propionate, 3-(4-hydroxy-3,5-di-t-butylphenyl) octyl propionate, tetrakis{3-(4-hydroxy-3,5-di-t-butylphenyl) propionyloxymethyl} methane, 3-(4-hydroxy-3,5-di-t-butylphenyl) glycerin propionate monoester, an ester of 3-(4-hydroxy-3,5-di-t-butylphenyl) propionate and glycerin monooleyl ether, 3-(4-hydroxy-3,5-di-t-butylphenyl) butylene propionate glycolate ester, 3-(4-hydroxy-3,5-di-t-butylphenyl) propionate thiodiglycolate ester, 4,4'-thiobis(3-methyl-6-t-butylphenol), 4,4'-thiobis(2-methyl-6-t-butylphenol), 2,2'-thiobis(4-methyl-6-t-butylphenol), 2,6-di-t-butyl-α-dimethylamino-p-cresol, 2,6-di-t-butyl-4-(N,N'-dimethylaminomethylphenol), bis(3,5-di-t-butyl-4-hydroxy benzyl) sulfide, tris{(3,5-di-t-butyl-4-hydroxyphenyl)propionyl-oxyethyl} isocyanulate, tris(3,5-di-t-butyl-4-hydroxyphenyl)isocyanulate, 1,3,5-tris(3,5-di-t-butyl-4-hydroxybenzyl)isocyanulate, bis{2-methyl-4-(3-n-alkylthiopropionyloxy)-5-t-butylphenyl} sulfide, 1,3,5-tris(4-t-butyl-3-hydroxy-2,6-dimethylbenzyl)isocyanulate, tetraphthaloyl-di(2,6-dimethyl-4-t-butyl-3-hydroxybenzyl sulfide), 6-(4-hydroxy-3,5-di-t-butylanilino)- 2,4-bis(octylthio)-1,3,5-triazine, 2,2-thio-{diethyl-bis-3-(3,5-di-t-butyl-4-hydroxyphenyl)}propionate, N,N'-hexamethylenebis(3,5-di-t-butyl-4-hydroxy-hydrocinnamido), 3,5-di-t-butyl-4-hydroxy-benzyl-phosphate diester, bis(3-methyl-4-hydroxy-5-t-butylbenzyl) sulfide, 3,9-bis[1,1-dimethyl-2-{β-(3-t-butyl-4-hydroxy-5-methylphenyl)propionyloxy}ethyl]-2,4,8,10-tetraoxaspiro[5,5]undecane, 1,1,3-tris(2-methyl-4-hydroxy-5-t-butylphenyl)butane, 1,3,5-trimethyl-2,4,6-tris(3,5-di-t-butyl-4-hydroxybenzyl)benzene, bis{3,3'-bis-(4'-hydroxy-3,3'-t-butylphenyl)butylic acid}glycolate ester and the like.

Examples of the amine-based antioxidant include naphtylamine-based antioxidants such as 1-naphtylamine, phenyl-1-naphtylamine, p-octylphenyl-1-naphtylamine, p-nonylphenyl-1-naphtylamine, p-dodecylphenyl-1-naphtylamine, phenyl-2-naphtylamine; phenylenediamine-based antioxidants such as N,N'-diisopropyl-p-phenylenediamine, N,N'-diisobutyl-p-phenylenediamine, N,N'-diphenyl-p-phenylenediamine, N,N'-di-p-naphtyl-p-phenylenediamine, N-phenyl-N'-isopropyl-p-phenylenediamine, N-cyclohexyl-N'-phenyl-p-phenylenediamine, N-1,3-dimethylbutyl-N'-phenyl-p-phenylenediamine, dioctyl-p-phenylenediamine, phenylhexyl-p-phenylenediamine, phenyloctyl-p-phenylenediamine; diphenylamine-based antioxidants such as dipyridylamine, diphenylamine, p,p'-di-n-butylphenylamine, p,p'-di-t-butyldiphenylamine, p,p'-di-t-pentyldiphenylamine, p,p'-dinonyldiphenylamine, p,p'-didecyldiphenylamine, p,p'-didodecyldiphenylamine, p,p'-distyryldiphenylamine, p,p'-dimethoxydiphenylamine, 4,4'-bis(4-α,α-dimethylbenzoyl)diphenylamine, p-isopropoxydiphenylamine, dipyridylamine; and phenothiazine-based antioxidants such as phenothiazine, N-methylphenothiazine, N-ethylphenothiazine, 3,7-dioctylphenothiazine, phenothiazine carboxylate ester, and phenoselenazine.

Examples of the sulfur-based antioxidant include dioctylthiodipropionate, didecylthiodipropionate, dilaurylthiodipropionate, dimyristylthiodipropionate, distearylthiodipropionate, laurylstearylthiodipropionate, dimyristylthiodipropionate, distearyl-β,β-thiodibutylate, (3-octylthiopropionic acid)pentaerythritol tetraester, (3-decylthiopropionic acid)pentaerythritol tetraester, (3-laurylthiopropionic acid)pentaerythritol tetraester, (3-stearylthiopropionic acid)pentaerythritol tetraester, (3-oleylthiopropionic acid)pentaerythritol tetraester, (3-laurylthiopropionic acid)-4,4'-thiodi(3-methyl-5-t-butyl-4-phenol)ester, 2-mercaptobenzimidazole, 2-mercaptomethylbenzimidazol, 2-benzimidazoldisulfide, dilaurylsulfide, amylthioglycolate and the like.

The amount of the component (D6) is preferably about 0.01 to 5% by weight base on the lubricant base oil.

The organic metal compound (D7) enhances wear resistance and antioxidation properties. Examples of the organic metal compound (D7) include salts of lithium, sodium, potassium, magnesium, calcium, barium, titanium, zinc, lead, tin, iron, cadmium, cobalt, nickel, manganese, strontium, vanadium, copper, antimony, bismuth and tungsten with fatty acids or naphthenic acids such as hexanoic acid, octanoic acid, pelargonic acid, decanoic acid, lauric acid, myristic acid, palmitic acid, stearic acid, oleic acid, behenic acid, linolenic acid and linolenic acid. The fatty acids preferably contain about 12 to 18 carbon atoms.

Also the organic metal compounds (D7) include dithiophosphoric acid metal salts, dithiocarbamic acid metal salts, mercaptobenzthiazole metal salts, mercaptobenzimidazole metal salts, benzamidothiophenol metal salts and the like. The metal atoms are described above.

The component (D8) is the oiliness improver containing no metal atoms, phosphorus atoms or sulfur atoms. Examples of the components (D8) include fatty acids such as hexanoic acid, octanoic acid, pelargonic acid, decanoic acid, lauric acid, myristic acid, palmitic acid, stearic acid, oleic acid, behenic acid, linolenic acid and linolenic acid; fats and oils such as linseed oil, perilla oil, oiticica oil, olive oil, cacao butter, kapok oil, white mustard oil, sesame oil, rice bran oil, safflower oil, shea nut oil, chinese wood oil, soybean oil, tea seed oil, tsubaki oil, corn oil, rape seed oil, palm oil, palm kernel oil, caster oil, sunflower oil, cotton seed oil, coconut oil, vegetable wax, peanut oil, horse tallow, beef tallow, neats foot oil, ghee, lard, goat tallow, mutton tallow, milk fat, fish oil, whale oil and the like and hydrides or partial saponifinicated variations thereof; epoxydated oils such as epoxydated soybean oil, epoxydated linseed oil and the like; epoxydated esters such as epoxy butyl stearate, epoxy octyl stearate and the like; dibasic acids such as glutaric acid, adipic acid, pimelic acid, suberic acid, azelaic acid, sebacic acid, dodecandioic acid, dimer acid and the like; polycondensed hydroxy stearate such as ricinoleic acid (caster oil fatty acid), 12-hydroxy stearic acid and the like or esters of the polycondensed products and fatty acids;

higher alcohols such as lauryl alcohol, myristyl alcohol, palmityl alcohol, stearyl alcohol, oleyl alcohol, behenyl alcohol; higher amines such as lauryl amine, myristyl amine, palmityl amine, stearyl amine, oleyl amine, behenyl amine and the like; higher amides such as lauryl amide, myristyl amide, palmityl amide, stearyl amide, oleyl amide, behenyl amide and the like; diethanol amide such as lauryl diethanol amide, myristyl diethanol amide, palmityl diethanol amide, stearyl diethanol amide, oleyl diethanol amide, behenyl diethanol amide and the like; glycerides such as hexanoic acid mono/di/triglyceride, octanoic acid mono/di/triglyceride, decanoic acid mono/di/triglyceride, lauric acid mono/di/triglyceride, myristic acid mono/di/triglyceride, palmitic acid mono/di/triglyceride, stearic acid mono/di/triglyceride, oleic acid mono/di/triglyceride, behenic acid mono/di/triglyceride and the like; polyglycerin esters such as polyglycerin hexanoate ester, polyglycerin octanoate ester, polyglycerin decanoate ester, polyglycerin laurate ester, polyglycerin myristate ester, polyglycerin palmitate ester, polyglycerin stearate ester, polyglycerin oleate ester, polyglycerin behenate ester and the like;

sorbitan esters such as sorbitan hexanoate ester, sorbitan octanoate ester, sorbitan decanoate ester, sorbitan laurate ester, sorbitan myristate ester, sorbitan palmitate ester, sorbitan stearate ester, sorbitan oleate ester, sorbitan behenate ester and the like; (poly)glycerin ethers such as (poly)glycerin monooctyl ether, (poly)glycerin monodecyl ether, (poly)glycerin monolauryl ether, (poly)glycerin monooleyl ether, (poly)glycerin monostearyl ether and the like; adducts of α-olefin oxides such as ethylene oxide, propylene oxide, dodecane-1,2-oxide and the like thereto. An amount of the component (D8) is preferably about 0.05 to 10% by weight based on the lubricating basestock.

The component (D9) is a preservative. Examples of the preservative include sulphonates listed in the examples of the metal detergent above, sodium nitrite, paraffin wax oxide calcium salts, paraffin wax oxide magnesium salts, beef tallow fatty acid alkali metal salts, alkali earth metal salts or amine salts, alkenyl succinates or alkenyl succinate half esters (alkenyl has a molecular weight of about 100 to 300), sorbitan monoesters, pentaerythritol monoesters, glycerin monoesters, nonylphenol ethoxylates, lanoline fatty acid esters, lanoline fatty acid calcium salts and the like. The amount of the component (D9) is preferably about 0.1 to 15% by weight based on the lubricating basestock.

The component (D10) is a viscosity index improver. Examples of the viscosity index improver include poly($C_1$ to $C_{18}$)alkyl methacrylates, ($C_1$ to $C_{18}$)alkyl acrylate/($C_1$ to $C_{18}$)alkyl methacrylate copolymers, diethylaminoethyl methacrylates/($C_1$ to $C_{18}$)alkyl methacrylate copolymers, ethylene/($C_1$ to $C_{18}$)alkyl methacrylate copolymers, polyisobutylenes, polyalkylstyrenes, ethylene/propylene copolymers, styrene/maleate ester copolymers, styrene/maleate amide copolymers, styrene/butadiene hydrogenated copolymers, styrene/isoprene hydrogenated copolymers and the like. The average molecular weight thereof is about 10,000 to 1,500,000. The amount of the component (D10) is preferably about 0.1 to 20% by weight based on the lubricating basestock.

The component (D11) is a metal inactivating agent. Examples of the metal inactivating agent include N,N'-salicylidene-1,2-propanediamine, alizarin, tetraalkylthiuram disulfide, benztriazole, benzimidazole, 2-alkyldithiobenzimidazole, 2-alkyldithiobenzthiazol, 2-(N,N-dialkyldithiocarbamoyl)benzthiazol, 2,5-bis(alkyldithio)-1,3,4-thiadiazol, 2,5-bis(N,N-dialkyldithiocarbamoyl)-1,3,4-thiadiazol and the like. The amount of the component (D11) is preferably about 0.01 to 5% by weight based on the lubricating basestock.

The component (D12) is a defoaming agent. Examples of the defoaming agent include polydimethylsilicone, trifluoropropylmethylsilicone, colloidal silica, polyalkylacrylates, polyalkylmethacrylates, alcoholethoxy/propoxylates, fatty acid ethoxy/propoxylates, sorbitan partial fatty acid esters and the like. The amount of the component (D12) is preferably about 0.001 to 1% by weight based on the lubricating basestock.

The component (D13) is a solid lubricant. Examples of the solid lubricant include graphite, molybdenum disulfide, polytetrafluoroethylenes, fatty acid alkali earth metal salts, mica, cadmium dichloride, cadmium diiodide, calcium fluoride, lead iodide, lead oxide, titanium carbide, titanium nitride, aluminum silicate, antimony oxide, cerium fluoride, polyethylene, diamond powder, silicon nitride, boron nitride, carbon fluoride, melamine isocyanurate and the like. The amount of the component (D13) is preferably about 0.005 to 2% by weight based on the lubricating basestock.

One or two or more of the above components (D) can be blended. When the lubricating composition is used as a lubricant for an internal combustion engine, at least the metal detergent (D1) and the antioxidant (D6) are preferably blended therein.

Examples of the lubricating basestock for use in the present invention include a lubricating base oil comprising mineral oils, synthetic oils or a mixture thereof and base grease obtained by mixing a thickener with such base oil. Otherwise, water is used when used as an aqueous lubricating oil.

When the lubricating composition of the present invention is used as a lubricant, the lubricating basestock has a non-limiting dynamic viscosity of 1 to 50 $mm^2/s$ at 100° C., about 10 to 1,000 $mm^2/s$ at 40° C., and a non-limiting viscosity index (VI) of preferably 100 or more, more preferably 120 or more, most preferably 135 or more.

The mineral oils used as the base oil of the lubricating composition of the present invention are separated from natural crude oils and are produced by appropriately distilling and refining them. The mineral oils include hydrocarbons (mainly paraffin) as main components and also include monocyclic naphtenes, bicyclic naphtenes, aromatics and the like. These mineral oils may preferably be refined by hydrofinishing, solvent deasphalting, solvent extraction, solvent dewaxing, hydrodewaxing, catalytic dewaxing, hydrocracking, alkali distillation, sulfuric acid cleaning, clay treatment or the like. These refining measures can be used in combination as appropriate, and it is advantageous that the same procedure may be repeated in multi stages. For example, it is advantageous that distillate is solvent extracted or hydrotreated after solvent extraction and then sulfuric acid cleaned (A), distillate is dewaxed after hydrotreatment (B), distillate is hydrotreated after solvent extraction (C), distillate is clay treated after solvent extraction (D), distillate is hydrotreated in two or three or more stages, or alkali distillated or sulfuric acid cleaned thereafter (E) and distillate is hydrotreated or alkali distilled or sulfuric acid cleaned after hydrotreatment (F), or these treated distillates are mixed.

These treatments can remove aromatics, sulfur content, nitrogen content and the like in non-refined mineral oils. Although these impurities can be reduced to trace amounts thereof by current technology, about 3 to 5% by weight of aromatics may remain since aromatics can make lubricant additives dissolve easily. For example, the sulfur content or nitrogen content of highly refined mineral oils is 0.01% by weight or less, or 0.005% by weight or less. In contrast, the aromatics content is 1% by weight or less, or 0.05% by weight or less, in some cases they are about 3% by weight.

The synthetic oil used as the base oil for use in the lubricating composition of the present invention is a chemically synthesized lubricant and includes poly-α-olefins, polyisobutylenes (polybutenes), diesters, polyolesters, aromatic polyhydric carboxylate esters, phosphate esters, silicate esters, polyalkylene glycols, polyphenyl ethers, silicones, fluorinated compounds, alkyl benzenes and the like. Specifically, poly-α-olefins, polyisobutylenes (polybutenes), diesters, polyolesters, polyalkylene glycols and the like can be versatilely used and preferably can be used for internal combustion engine oil or metal processing oil.

Examples of the poly-α-olefins include polymers, oligomers or hydrogenated matters of 1-hexene, 1-octene, 1-nonene, 1-decene, 1-dodecene, 1-tetradecene and the like. Examples of the diesters include diesters of dibasic acids such as glutaric acid, adipic acid, azelaic acid, sebacic acid, dodecandioic acid and the like and alcohols such as 2-ethylhexanol, octanol, decanol, dodecanol, tridecanol and the like. Examples of the polyol esters include esters of polyols such as neopentylglycol, trimethylolethane, trimethylolpropane, glycerin, pentaerythritol, sorbitol, dipentaerythritol, tripentaerythritol, or alkylene oxide adducts thereof and the like and fatty acids such as butyric acid, isobutyric acid, valerianic acid, isovalerianic acid, pivalic acid, capric acid, caproic acid, caprylic acid, lauric acid, myristic acid, palmytic acid, stearic acid, oleic acid and the like. Examples of the polyalkylene glycols include polyethylene glycols, polypropylene glycols, polyethylene glycol monomethyl ethers, mono- or dimethyl ethers of ethylene oxide/propylene oxide block or random copolymers and the like.

These synthetic oils are chemically synthesized and therefore are a single substance or a homogeneous mixture. The synthetic oils such as poly-α-olefins, polyisobutylenes (polybutenes), diesters, polyolesters, polyalkylene glycols and the like do not contain the impurities included in mineral oils such as aromatic components, i.e., benzene, condensed ring aromatic component, sulfur content, i.e., thiophene, nitrogen content, i.e., indole, carbazole, or the like.

As the grease, a base grease where a thickener is mixed with the base oil is used. Examples of the thickener include a soap-based or complex-based soap thickener, a terephthalamate-based thickener, a urea-based thickener, an organic non-soap-based thickener, an inorganic non-soap-based thickener such as polyterafluoroethylene, fluoroethylene-propylene copolymer and the like.

The thickener may be used alone or in combination. A non-limiting amount of the thickener is preferably 3 to 40% by weight, more preferably 5 to 20% by weight based on base grease comprising base oil and a thickener. Typically, the base grease comprising the base oil and the thickener has non-limiting consistency of 100 to 500.

The total content of alkali metals contained in the lubricating composition of the present invention is preferably 0.02% by weight or less, more preferably 0.01% by weight or less calculated in terms of the total amount of the alkali metals. The alkali metal enters into the lubricating composition, when the alkali metal is used as a catalyst or a raw material and is not completely removed in separation, refining or synthesizing of the base oil. The alkali metals or its salts are often used as raw materials or catalysts in a synthesizing step of lubricant additives and may not be completely removed. When molybdenum oxysulfide dithiocarbamate and molybdenum oxysulfide dithiophosphate are produced, inorganics containing alkali metals are often used. Further, sodium nitrite or sodium sulphonate may be used as a preservative, and alkali metal compounds may be added as a detergent or a dispersant.

The total nitrogen content of the lubricating composition of the present invention is preferably 0.01% by weight or more, more preferably 0.03% by weight or more and most preferably 0.05% by weight or more calculated in terms of the total amount of the nitrogen content. Nitrogen may enter into the lubricating composition, when the component (B) contains nitrogen, when molybdenum oxysulfide dithiocarbamate represented by the formula (1) is used as the component (A), when the amine-based antioxidant is used as an antioxidant, when a dithiocarbamate derivative is used, or when a fatty acid amide is used.

The lubricating composition of the present invention can be used for any lubricating application. For example, the lubricating composition herein can be added to an industrial lubricant, turbine oil, machine oil, bearing oil, compressor oil, hydraulic fluid, working fluid, internal combustion engine oil, refrigerator oil, gear oil, automatic transmission fluid (ATF), continuously variable infinity transmission oil (CVT oil), transaxle fluid, metal working fluid or the like. Also it can be added to various greases for use in plain bearings, ball-and-roller bearings, gears, universal joints, torque limiters, automotive constant velocity joints (CVJ), ball joints, wheel bearings, constant velocity gears, transmission gears or the like.

Most preferably, the lubricating composition of the present invention is used as a lubricant for internal combustion engines such as gasoline and diesel engines.

EXAMPLES

Examples of the present invention and Comparative Examples are given below by way of illustration, and are not in any way designed to limit its scope. All parts and percentages are by weight unless otherwise specified.

Example 1

The lubricating compositions of the Examples and Comparative Examples were prepared using the lubricating base oils, components (A), components (B) and components (C) described below and were tested for their friction coefficients by the following method to evaluate lubricity. Mixing ratios of respective components are shown in Table 1.

The base oils used were as follows:

Examples 1 to 9: base oil 1

Examples 9 to 14: base oil 2

Example 15: base oil 3

(i) Lubricating base oil

Base oil 1: mineral oil-based high VI oil kinematic viscosity of 4.1 $mm^2/s$ (100° C.)

18.3 $mm^2/s$ (40° C.)

viscosity index (VI)=126

Base oil 2: synthetic oil comprising 80% of poly-α-olefin obtained by oligomerizing 1-decene and 20% of polyolester.

kinematic viscosity of 4.0 $mm^2/s$ (100° C.)

of 16.9 $mm^2/s$ (40° C.)

viscosity index (VI)=138

Base oil 3: mixed base oil where the base oil 1 and 2 are mixed in 1:1 ratio.

(ii) component (A)

(A-1): in the formula (1), $R^1$=$R^2$=2-ethylhexyl group, $R^3$=$R^4$=isotridecyl group, S/O=2.0/2.0 in $X^1$ to $X^4$ (A-2): in the formula (1), $R^1$ to $R^4$=2-ethylhexyl group, S/O=2.0/2.0 in $X^1$ to $X^4$ (A-3): reaction product of molybdenum trioxide and diisotridecylamine (in the formula (3), $R^9$=$R^{10}$=isotridecyl group) in a mole ratio of 1:2.

(A-4): in the formula (2), $R^5$ to $R^8$=2-ethylhexyl group, S/O=2.0/2.0 in $X^5$ to $X^8$ (iii) component (B)

(B-1): polybutenyl succinimide (α/β=0.004, nitrogen content of 0.7%, molecular weight of 2,400)

(B-2): polybutenyl succinimide (α/β=0.004, nitrogen content of 1.0%, molecular weight of 2,000)

(B-3): polybutenyl succinimide boron compound (α/β=0.006, nitrogen content of 1.2%, molecular weight of 1,800)

(B-4): polybutenyl succinimide (α/β=0.10, nitrogen content of 2.0%, molecular weight of 700)

(iv) component (C)

(C-1): in the formula (4), $R^{11}$=$R^{12}$=2-ethylhexyl group, neutral salts/based salts=95/5 (mole ratio)

(C-2): in the formula (4), $R^{11}$=$R^{12}$=secondary propyl group and secondary hexyl group coexist, neutral salts/based salts=95/5 (mole ratio)

Figure 2:
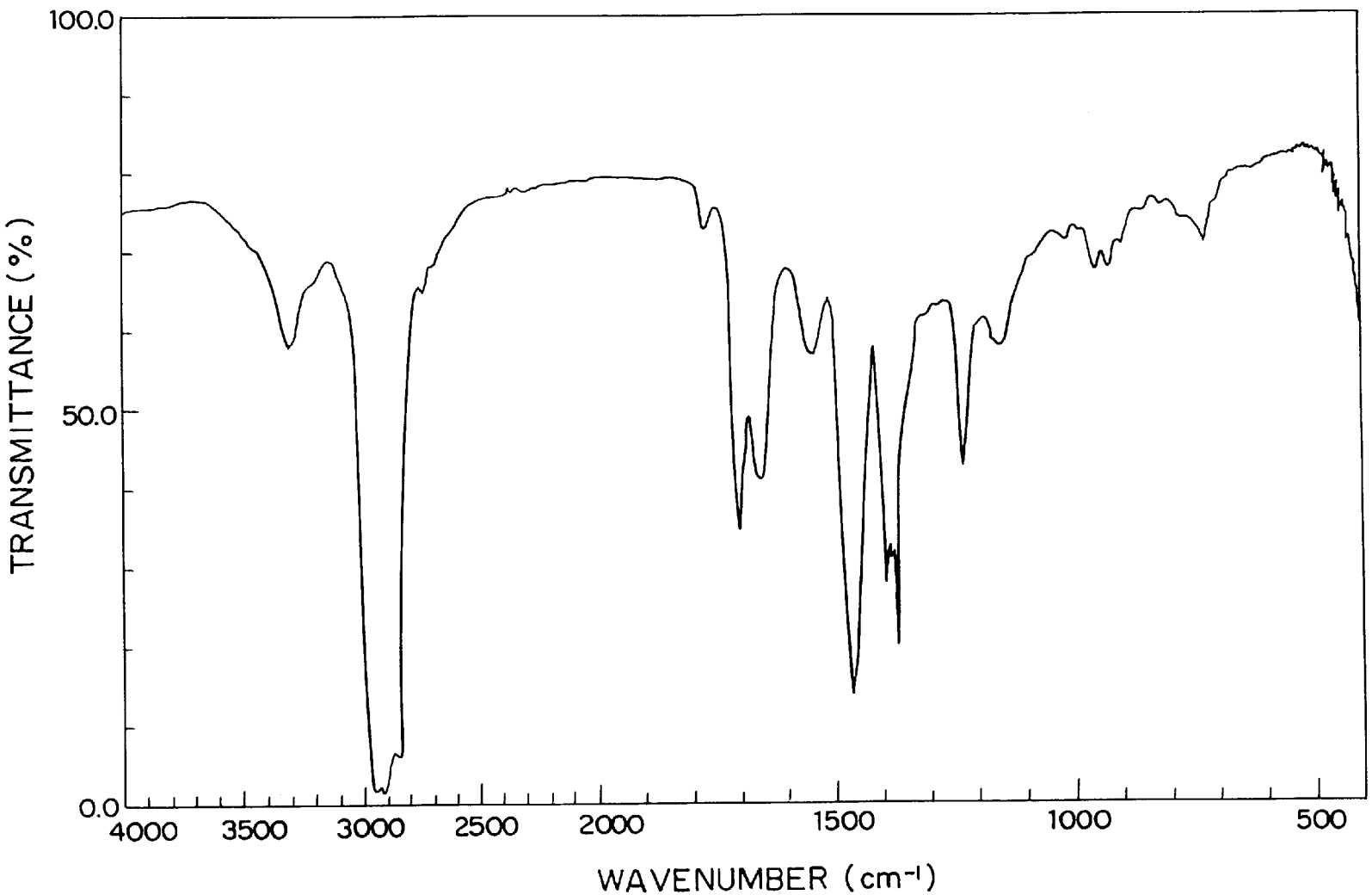
FIG. 2 shows an IR spectrum chart of the component (B-4) used in Example 1.

FIG. 1 shows an IR spectrum chart of the (B-1) and FIG. 2 shows an IR spectrum chart of the (B-4). Based on the charts, intensity ratio of the IR spectra α/β of both components were determined.

(v) Friction coefficient measurement

Activated carbon was added to each of the lubricating compositions of Examples and Comparative Examples shown in Table 1 and fully agitated using a stirrer. Each of the lubricating compositions was measured for friction coefficient using an SRV measuring tester under a linear contact of a cylinder on a plate. The top cylinder had a size of 15°×22 mm and the plate had a size of 24°×6.85 mm. The cylinder was set on the plate vertical to the sliding direction and vibrated reciprocatingly to determine the friction coefficient. The material of both the cylinder and the plate were SUJ-2. The followings are the detailed measuring conditions.

<Measuring conditions>

Load: 200N

Temperature: 80° C.

Measuring time: 15 minutes

Amplitude: 1.0 mm

Cycle: 50 Hz

Table 1 shows the measured results of these friction coefficients.

TABLE 1

| | Component (A) (Mo · ppm) | | Component (B) (%) | | Component (C) (P · ppm) | | Friction coefficient |
|---|---|---|---|---|---|---|---|
| Ex. 1 | A-1 | 600 | B-1 | 8.0 | C-2 | 1,000 | 0.07 |
| Ex. 2 | A-1 | 600 | B-2 | 8.0 | C-2 | 1,000 | 0.07 |
| Ex. 3 | A-1 | 600 | B-3 | 8.0 | C-2 | 1,000 | 0.07 |
| Ex. 4 | A-2 | 600 | B-1 | 8.0 | C-2 | 1,500 | 0.07 |
| Ex. 5 | A-2 | 600 | B-2 | 8.0 | C-1 | 1,000 | 0.07 |
| Ex. 6 | A-2 | 600 | B-3 | 8.0 | C-1 | 1,000 | 0.07 |
| Ex. 7 | A-3 | 600 | B-3 | 8.0 | C-1 | 1,000 | 0.08 |
| Ex. 8 | A-4 | 600 | B-3 | 8.0 | C-1 | 1,000 | 0.07 |
| Ex. 9 | A-1 | 600 | B-3 | 8.0 | C-1 | 800 | 0.07 |
| Ex. 10 | A-1 | 300 | B-3 | 8.0 | C-1 | 200 | 0.07 |
| | A-2 | 300 | | | C-2 | 800 | |
| Ex. 11 | A-1 | 400 | B-2 | 8.0 | C-1 | 300 | 0.07 |
| | A-3 | 200 | | | C-2 | 700 | |
| Ex. 12 | A-1 | 400 | B-1 | 4.0 | C-2 | 1,000 | 0.07 |
| | A-2 | 200 | B-2 | 4.0 | | | |
| Ex. 13 | A-1 | 600 | B-3 | 15.0 | C-1 | 1,000 | 0.07 |
| Ex. 14 | A-1 | 300 | B-3 | 8.0 | C-1 | 1,000 | 0.08 |
| Ex. 15 | A-1 | 700 | B-2 | 5.0 | C-1 | 300 | 0.08 |
| | | | | | C-2 | 700 | |
| C Ex. 1 | A-1 | 600 | B-4 | 8.0 | C-1 | 1,000 | 0.10 |
| C Ex. 2 | A-2 | 600 | B-4 | 8.0 | C-1 | 1,000 | 0.10 |
| C Ex. 3 | A-1 | 300 | B-4 | 8.0 | C-1 | 1,000 | 0.10 |
| | A-2 | 300 | | | | | |

Example 2

The lubricating compositions of the present invention were prepared by mixing the lubricating composition of Example 1 or 14 with component (D) and other components. Mixing ratios of respective components are shown in Table 2 to 10. These lubricating compositions were tested as described in Example 1. In the blends 1 shown in Tables 2, Comparative Example 1 is used instead of Example 1 to measure the friction coefficients for comparison. Respective amounts of the components (% by weight) are based on the base oil.

TABLE 2

| Blend 1<br>Example 1 | (%) |
|---|---|
| Ca salicylate (TBN190) | 3.0 |
| Tetraoctylthiuram disulfide | 1.0 |
| Glycerin monoolate | 1.0 |
| Benzimidazole | 0.1 |
| Polydimethylsilicone | 0.01 |
| Polymethacrylate | 3.0 |

TABLE 3

| Blend 2<br>Example 1 | (%) |
|---|---|
| Ca sulphonate (TBN300) | 3.0 |
| Sulfurized sperm oil | 0.5 |
| Dilaurylthiodipropionate | 0.5 |

TABLE 3-continued

| Blend 2<br>Example 1 | (%) |
|---|---|
| Zinc dioctyldithiocarbamate | 1.0 |
| Benzimidazole | 0.1 |
| Polydimethylsilicone | 0.01 |
| Ethylene-propylene copolymer | 3.0 |

TABLE 4

| Blend 3<br>Example 1 | (%) |
|---|---|
| 2,6-di-t-butylcresole | 0.5 |
| Ca salicylate (TBN280) | 3.0 |
| Dibenzyldisulfide | 0.5 |
| Dibenzylmonosulfide | 0.5 |
| Copper oleate | 0.5 |
| Diethanolamide laurate | 0.1 |
| Benzimidazole | 0.1 |
| Polydimethylsilicone | 0.01 |
| Polymethacrylate | 3.0 |

TABLE 5

| Blend 4<br>Example 1 | (%) |
|---|---|
| Ca sulphonate (TBN28) | 2.0 |
| Ca phenate (TBN255) | 1.0 |
| 2,5-di(4,5-dithianonyl)-1,3,4-thiadiazol | 0.5 |
| Sulfurized fish oil | 0.5 |
| Antimony dioctyldithiocarbamate | 0.1 |
| N,N'-salicylidene-1,2-propanediamine | 1.0 |
| Polydimethylsilicone | 0.01 |
| Ethylene-propylene copolymer | 3.0 |

TABLE 6

| Blend 5<br>Example 1 | (%) |
|---|---|
| Ca salicylate (TBN190) | 2.0 |
| Ca salicylate (TBN280) | 1.0 |
| Sorbitan sesquiolate | 1.0 |
| Benzimidazole | 0.1 |
| Polymethacrylate | 3.0 |

TABLE 7

| Blend 6<br>Example 1 | (%) |
|---|---|
| Ca salicylate (TBN280) | 1.5 |
| Mg salicylate (TBN400) | 1.5 |
| Benzimidazole | 0.1 |
| Polymethacrylate | 3.0 |

TABLE 8

| Blend 7<br>Example 1 | (%) |
|---|---|
| Ca sulphonate (TBN300) | 1.5 |
| Mg sulphonate (TBN400) | 1.5 |
| Zinc dioctyldithiocarbamate | 1.0 |
| Benzylamine (average molecular weight of 1,000) | 1.0 |
| Benzimidazole | 0.1 |
| Polydimethylsilicone | 0.01 |
| Ethylene-propylene copolymer | 5.0 |

TABLE 9

| Blend 8<br>Example 1 | (%) |
|---|---|
| Dilaurylthiodipropionate | 0.5 |
| Mg sulphonate (TBN400) | 3.0 |
| Dibenzyl disulfide | 0.5 |
| Oleylamine | 3.0 |
| Benzimidazole | 0.1 |
| Polymethacrylate | 3.0 |

TABLE 10

| Blend 9<br>Example 14 | (%) |
|---|---|
| Ca salicylate (TBN190) | 2.0 |
| Ca salicylate (TBN280) | 1.0 |
| 2,5-di(4,5-dithianonyl)-1,3,4-thiadiazole | 0.5 |
| Benzimidazole | 0.1 |
| Polydimethylsilicone | 0.01 |
| Ethylene-propylene copolymer | 5.0 |

The friction coefficients of blends 1 to 9 of the present invention were in the range of 0.07 to 0.08. In sharp contrast, the friction coefficients of blend 1 where the Comparative Example 1 was used instead of Example 1 were in the range of 0.10 to 0.15.

According to the present invention, a lubricating composition showing excellent lubricity even when soot is present is provided. The lubricating composition of the present invention can be suitably used for internal combustion engines such as gasoline and diesel engines.

What is claimed is:

1. A lubricating composition, comprising a lubricating basestock, an organic molybdenum compound (A) and succinimide compound (B) having an IR spectrum absorbance peak intensity ratio $\alpha/\beta$ of 0.01 or less, wherein $\alpha$ represents an absorbance peak intensity at 1,550±10 $cm^{-1}$ and $\beta$ represents an absorbance peak intensity at 1,700±10 $cm^{-1}$.

2. A lubricating composition according to claim 1, wherein the organic molybdenum compound is molybdenum oxysulfide dithiocarbamate represented by the following formula (1):

(1)

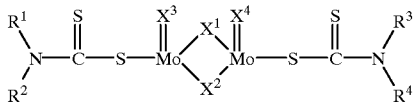

wherein $R^1$ to $R^4$ each independently represent a hydrocarbon group, and $X^1$ to $X^4$ each independently represent a sulfur atom or an oxygen atom;

molybdenum oxysulfide dithiophosphate represented by the following formula (2):

(2)

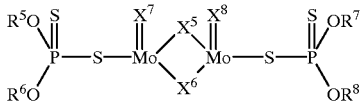

wherein $R^5$ to $R^8$ each independently represent a hydrocarbon, and $X^5$ to $X^8$ each independently represent a sulfur atom or an oxygen atom; or a reaction product of an amine represented by the following formula (3):

$$R^9—NH—R^{10} \quad (3)$$

wherein $R^9$ and $R^{10}$ each independently represent a hydrogen atom or a hydrocarbon group with the proviso that both $R^9$ and $R^{10}$ are never hydrogen atoms with a compound having at least one pentavalent or hexavalent molybdenum atom.

3. A lubricating composition according to claim 1, further comprising zinc dithiophosphate (C) represented by the following formula (4):

(4)

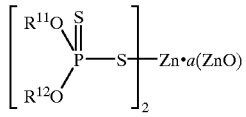

wherein $R^{11}$ and $R^{12}$ each independently represent a hydrocarbon group, and a represents 0 to 1/3.

4. A lubricating composition according to claim 1, wherein a molecular weight of the succinimide compound (B) is 500 to 10,000.

5. A lubricating composition according to claim 1, wherein a total nitrogen content contained in the lubricating composition is 0.01% by weight or more.

6. A lubricating composition according to claim 1, further comprising one or more selected from the group consisting of:

a metal detergent (D1), an ashless dispersant other than succinimide compound (D2), a compound containing a phosphorus atom (D3), a compound containing a phosphorus atom and a sulfur atom (D4), a compound containing a sulfur atom and no metal atoms (D5), an antioxidant (D6), an organic metal compound (D7), an oiliness improver containing no metal atoms, phosphorus atoms or sulfur atoms (D8), a preservative (D9), a viscosity index improver (D10), a metal deactivating agent (D11), an antifoaming agent (D12), and a solid lubricant (D13).

* * * * *